US009839917B2

(12) United States Patent
Greet et al.

(10) Patent No.: US 9,839,917 B2
(45) Date of Patent: Dec. 12, 2017

(54) METHOD FOR RECOVERING A COPPER SULFIDE CONCENTRATE FROM AN ORE CONTAINING AN IRON SULFIDE

(71) Applicants: Christopher Greet, Greenwith (AU); Gerhard Arnold, Ringwood, NJ (US); Ingo Hamann, Chester, NJ (US); Alan Hitchiner, Morrinsville (NZ)

(72) Inventors: Christopher Greet, Greenwith (AU); Gerhard Arnold, Ringwood, NJ (US); Ingo Hamann, Chester, NJ (US); Alan Hitchiner, Morrinsville (NZ)

(73) Assignees: Evonik Degussa GmbH, Essen (DE); Magotteaux International S.A., Vaux-sous-Chèvremont (BE)

( * ) Notice: Subject to any disclaimer, the term of this patent is extended or adjusted under 35 U.S.C. 154(b) by 0 days.

(21) Appl. No.: 14/904,696

(22) PCT Filed: Jul. 11, 2014

(86) PCT No.: PCT/EP2014/064945

§ 371 (c)(1),
(2) Date: Jan. 13, 2016

(87) PCT Pub. No.: WO2015/007649

PCT Pub. Date: Jan. 22, 2015

(65) Prior Publication Data

US 2016/0144381 A1 May 26, 2016

Related U.S. Application Data

(60) Provisional application No. 61/856,375, filed on Jul. 19, 2013.

(51) Int. Cl.

| | |
|---|---|
| ***B03D 1/00*** | (2006.01) |
| ***B03D 1/02*** | (2006.01) |
| ***C22B 15/00*** | (2006.01) |
| ***B03D 1/08*** | (2006.01) |
| ***C22B 1/00*** | (2006.01) |
| ***C22B 3/12*** | (2006.01) |
| ***C22B 3/00*** | (2006.01) |
| ***C22C 37/06*** | (2006.01) |

(52) U.S. Cl.

CPC ..... *B03D 1/025* (2013.01); *B03D 1/085* (2013.01); *C22B 1/005* (2013.01); *C22B 3/12* (2013.01); *C22B 11/04* (2013.01); *C22B 15/0008* (2013.01); *C22B 15/008* (2013.01); *C22C 37/06* (2013.01); *B03D 2201/007* (2013.01); *B03D 2201/02* (2013.01); *B03D 2203/02* (2013.01)

(58) Field of Classification Search

CPC ..... C22B 15/0008; C22B 15/0065; C22B 15/008; C22B 1/005; B03D 1/025; B03D 1/085

USPC ..... 423/26; 241/21

See application file for complete search history.

(56) References Cited

U.S. PATENT DOCUMENTS

| | | | |
|---|---|---|---|
| 1,893,517 | A | 1/1933 | Gaudin |
| 2,310,240 | A | 2/1943 | Keck |
| 2,559,104 | A | 7/1951 | Arbiter, et al. |
| 3,137,649 | A | 6/1964 | De Benedictis et al. |
| 3,426,896 | A | 2/1969 | Baarson et al. |
| 3,539,002 | A | 11/1970 | Last |
| 3,811,569 | A | 5/1974 | Shirley et al. |
| 4,098,686 | A | 7/1978 | Petrovich |
| 4,174,274 | A | 11/1979 | Tolley et al. |
| 4,466,886 | A | 8/1984 | Petrovich |
| 4,549,959 | A | 10/1985 | Armstrong et al. |
| 4,588,498 | A | 5/1986 | Mair et al. |
| 4,600,505 | A | 7/1986 | Mair et al. |
| 4,618,461 | A | 10/1986 | Bergman et al. |
| 4,702,824 | A | 10/1987 | Abadi |
| 4,902,765 | A | 2/1990 | Wang et al. |
| 5,013,359 | A | 5/1991 | Fair et al. |
| 5,037,533 | A | 8/1991 | Piedrahita et al. |
| 5,110,455 | A | 5/1992 | Huch |
| 5,171,428 | A | 12/1992 | Beattie et al. |
| 5,295,585 | A | 3/1994 | Huch |
| 5,389,274 | A | 2/1995 | Fernandez |
| 5,411,148 | A | 5/1995 | Kelebek et al. |
| 5,837,210 | A | 11/1998 | Simmons et al. |
| 5,902,977 | A | 5/1999 | Arbiter |

(Continued)

FOREIGN PATENT DOCUMENTS

| | | |
|---|---|---|
| AU | 2010236082 | 5/2011 |
| BR | 9505931 | 12/1997 |

(Continued)

OTHER PUBLICATIONS

Office Action for Kazakhstan patent application 2014/1682.1,(for corresponding copending U.S. Appl. No. 14/374,526, with English language translation attached, dated Apr. 7, 2016.

First page of Kazakhstan patent KZ 3930 C with U.S. Pat. No. 4,902,765 attached, Sep. 16, 1996.

International Search Report for PCT/EP2014/064945 (international counterpart of U.S. Appl. No. 14/904,696), filed Jul. 11, 2014.

Written Opinion of the International Searching Authority for PCT/EP2014/064945 (international counterpart of U.S. Appl. No. 14/904,696), filed Jul. 11, 2014.

International Preliminary Report on Patentability for PCT/EP2014/064945 (international counterpart of U.S. Appl. No. 14/904,696), filed Jul. 11, 2014.

(Continued)

*Primary Examiner* — Steven Bos

(74) *Attorney, Agent, or Firm* — Law Office of: Michael A. Sanzo, LLC

(57) ABSTRACT

In a method for recovering a copper sulfide concentrate by froth flotation from an ore containing an iron sulfide, wet grinding of the ore with grinding media made of high chromium cast iron alloy having a chromium content of from 10 to 35% by weight is combined with an addition of hydrogen peroxide to the conditioned mineral pulp before or during flotation in order to improve concentrate grade and recovery of copper sulfides.

20 Claims, 7 Drawing Sheets

(56) References Cited

U.S. PATENT DOCUMENTS

| | | | | |
|---|---|---|---|---|
| 6,210,648 | B1 * | 4/2001 | Gathje | B03D 1/02 423/26 |
| 6,390,303 | B1 | 5/2002 | Clark et al. | |
| 6,427,843 | B1 | 8/2002 | Clark | |
| 7,004,326 | B1 | 2/2006 | Dai et al. | |
| 2003/0231995 | A1 | 12/2003 | Jara et al. | |
| 2004/0222164 | A1 | 11/2004 | Conaway et al. | |
| 2014/0369906 | A1 | 12/2014 | Arnold et al. | |
| 2016/0158768 | A1 | 6/2016 | Arnold et al. | |
| 2016/0167060 | A1 | 6/2016 | Arnold et al. | |

FOREIGN PATENT DOCUMENTS

| | | | |
|---|---|---|---|
| EP | 0 261 847 | | 3/1988 |
| GB | 340 598 | | 1/1981 |
| GB | 2 182 587 | | 5/1987 |
| RU | 2 067 030 | | 9/1996 |
| RU | 2 426 598 | C1 | 8/2011 |
| RU | 2 432 999 | C2 | 11/2011 |
| WO | WO 87/00088 | | 1/1987 |
| WO | WO 93/22060 | | 11/1993 |
| WO | WO 03/045567 | | 6/2003 |
| WO | WO 2011/067680 | | 6/2011 |
| WO | WO 2013/110420 | | 8/2013 |
| WO | WO 2013/110757 | | 8/2013 |
| WO | WO 2015/007652 | A1 | 1/2015 |
| WO | WO 2015/007654 | A1 | 1/2015 |

OTHER PUBLICATIONS

International Search Report for PCT/EP2013/051438 (international counterpart of U.S. Appl. No. 14/374,526), filed Jan. 25, 2013.
Written Opinion of the International Searching Authority for PCT/EP2013/051438 (international counterpart of U.S. Appl. No. 14/374,526), filed Jan. 25, 2013.
International Preliminary Report on Patentability for PCT/EP2013/051438 (international counterpart of U.S. Appl. No. 14/374,526), filed Jan. 25, 2013.
International Search Report for PCT/EP2012/076297, filed Dec. 20, 2012.
Written Opinion of the International Searching Authority for PCT/EP2012/076297, filed Dec. 20, 2012.
International Preliminary Report on Patentability for PCT/EP2012/076297, filed Dec. 20, 2012.
International Search Report for PCT/EP2014/064953 (international counterpart of U.S. Appl. No. 14/904,697), filed Jul. 11, 2014.
Written Opinion of the International Searching Authority for PCT/EP2014/064953 (international counterpart of U.S. Appl. No. 14/904,697), filed Jul. 11, 2014.
International Preliminary, Report on Patentability for PCT/EP2014/064953 (international counterpart of U.S. Appl. No. 14/904,697), filed Jul. 11, 2014.
International Search Report for PCT/EP2014/064957 (international counterpart of U.S. Appl. No. 14/904,698), filed Jul. 11, 2014.
Written Opinion of the International Searching Authority for PCT/EP2014/064957 (international counterpart of U.S. Appl. No. 14/904,698), filed Jul. 11, 2014.
International Preliminary Report on Patentability for PCT/EP2014/064957 (international counterpart of U.S. Appl. No. 14/904,698), filed Jul. 11, 2014.
Bruckard, et al., "The flotation of metallic arsenic as a function of pH and pulp potential—A single mineral study," *Int. J. Miner. Process*. 84(1-4):25-32 (Sep. 2007).
Dai, et al., "Arsenic Rejection in the Flotation of Garson Ni—Cu Ore," Australian Institute of Mining and Metallurgy Publication Series: Centenary of Flotation Symposium; pp. 939-946 (Jun. 6, 2005).
Hintikka, et al., "Potential control in the flotation of sulphide minerals and precious metals," *Minerals Engineering* 8(10):1151-1158 (Oct. 1995).
Jones, "Some recent developments in the measurement and control of xanthate, perxanthate, sulphide, and redox potential in flotation," *Int. J. Miner. Process*. 33(1-4):193-205 (Jan. 1991).
Ma, et al., "Rejection of arsenic minerals in sulfide flotation—A literature review," *Int. J. Miner. Process*. 93(2):89-94 (Oct. 2009).
Ralston, "$E_h$ and Its Consequences in Sulphide Mineral Flotation," *Minerals Engineering* 4(7-11):859-878 (Jan. 1991).
Richardson, et al., "Electrochemical Control of Sulfide Flotation Circuits, Symposium on Emerging Computer Techniques for the Mineral Industry," pp. 307-317 (Feb. 1, 1993).
Uribe-Salas, et al., "Metallurgical improvement of a lead/copper flotation stage by pulp potential control," *Int. J. Miner. Process*. 59(1):69-83 (Apr. 2000).
English language abstract for BR9505931, listed as document B2 above, (published Dec. 23, 1997).
English language abstract for RU2067030, listed as document B6 above, (published Sep. 27, 1996).
U.S. Appl. No. 14/904,697, Jan. 13, 2016, Arnold.
U.S. Appl. No. 14/904,698, Jan. 13, 2016, Arnold.
Office Action for copending U.S. Appl. No. 14/374,526, mailed Dec. 12, 2016.
Office Action for copending U.S. Appl. No. 14/904,697, mailed Feb. 28, 2017.
Office Action for copending U.S. Appl. No. 14/904,698, mailed Feb. 23, 2017.
Response to Office Action for copending U.S. Appl. No. 14/374,526, filed Mar. 15, 2017.
Response to Office Action for copending U.S. Appl. No. 14/904,697, filed May 27, 2017.
Response to Office Action for copending U.S. Appl. No. 14/904,698, filed May 22, 2017.
Office Action for copending U.S. Appl. No. 14/374,526, dated Jun. 5, 2017.
Greet, et al., "Is Measuring pH Enough'?" Metallurgical Plant and Operating Strategies (*MetPlant 2006*), Sep. 18-19, 2006, Perth, WA. (Sep. 2006).
Response to Office Action of Jun. 5, 2017 for copending U.S. Appl. No. 14/374,526, filed Sep. 5, 2017.
Office Action for copending U.S. Appl. No. 14/904,697, dated Sep. 27, 2017.
Office Action for copending U.S. Appl. No. 14/904,698, dated Oct. 2, 2017.

* cited by examiner

METHOD FOR RECOVERING A COPPER SULFIDE CONCENTRATE FROM AN ORE CONTAINING AN IRON SULFIDE

CROSS REFERENCE TO RELATED APPLICATIONS

The present application is US national stage of international application PCT/EP2014/064945, which had an international filing date of Jul. 11, 2014, and which was published in English under PCT Article 21(2) on Jan. 22, 2015. The application claims the benefit of U.S. provisional application 61/856,375, filed on Jul. 19, 2013.

FIELD OF THE INVENTION

The present invention is directed to a method of recovering a copper sulfide concentrate from an ore containing an iron sulfide which provides an improvement in concentrate grade and recovery of copper sulfides, has a low consumption of processing chemicals and can be easily adapted to changing ore compositions.

BACKGROUND OF THE INVENTION

The most common method for recovering a copper sulfide concentrate from an ore is by froth flotation. The ore is wet ground to form a mineral pulp, which is usually conditioned with a collector compound that adsorbs to the surface of copper sulfide minerals and makes the surface of copper sulfide minerals more hydrophobic. A gas is then passed through the mineral pulp to form gas bubbles, hydrophobic particles of the mineral pulp attach predominantly to the gas/liquid phase boundary of the bubbles and are carried with the gas bubbles to the froth that forms on top of the mineral pulp. The froth is removed from the liquid surface to recover a copper sulfide concentrate.

Wet grinding of the mineral pulp is usually carried out with steel grinding media, most commonly steel balls in a ball mill. It is known that use of high chromium cast iron alloy grinding media can improve the recovery of copper sulfides during flotation as compared to the use of carbon steel grinding media. It is believed that corrosion of carbon steel and adsorption of iron species, formed by such corrosion, onto the surface of copper sulfides depresses flotation of copper sulfides and that high chromium cast iron alloy grinding media improve recovery of copper sulfides during flotation due to the better corrosion resistance of such alloys.

Most copper sulfide ores contain iron sulfides in addition to copper sulfides and one aims at achieving selective flotation of copper sulfides, with iron sulfides remaining in the flotation tailings.

U.S. Pat. No. 5,110,455 discloses a method for separating copper sulfide from rimmed iron sulfide which uses conditioning of the mineral pulp with an oxidant that is preferably hydrogen peroxide. The document teaches to add an oxidant in an amount that raises the redox potential of the mineral pulp by 20 to 500 mV.

A Uribe-Salas et al., Int. J. Miner. Process. 59 (2000) 69-83 describe an improvement in the selectivity for the flotation of chalcopyrite from an ore of pyrite matrix by raising the redox potential of the mineral pulp by 0.1 V through an addition of hydrogen peroxide before flotation. The amount of hydrogen peroxide added is adjusted to provide a constant redox potential.

SUMMARY OF THE INVENTION

The inventors of the present invention have found that combining wet grinding of copper sulfide ore with grinding media made of high chromium cast iron alloy having a chromium content of from 10 to 35% by weight with an addition of hydrogen peroxide to the conditioned mineral pulp before or during flotation achieves a synergistic effect, improving concentrate grade and recovery of copper sulfides. The inventors have also found that such combination significantly reduces the amount of hydrogen peroxide needed to achieve an optimum recovery of copper sulfides from the ore.

The present invention is therefore directed to a method for recovering a copper sulfide concentrate from an ore containing an iron sulfide, which method comprises the steps of a) wet grinding the ore with grinding media to form an mineral pulp,
b) conditioning the mineral pulp with a collector compound to form a conditioned mineral pulp, and
c) froth flotation of the conditioned mineral pulp to form a froth and a flotation tailing, separating the froth from the flotation tailing to recover a copper sulfide concentrate, and wherein grinding media made of high chromium cast iron alloy with a chromium content of from 10 to 35% by weight are used in step a) and hydrogen peroxide is added to the conditioned mineral pulp between steps b) and c) or during step c).

The inventors of the present invention have also found that the optimum amount of hydrogen peroxide to be used in this method can be determined based on the concentration of dissolved oxygen in the mineral pulp after addition of hydrogen peroxide and that an optimum recovery of copper sulfides can be maintained by adjusting the amount of hydrogen peroxide to maintain a minimum concentration of dissolved oxygen. This allows adapting the method to changes in the ore composition without carrying out ore assays or extra optimization experiments.

DETAILED DESCRIPTION OF THE INVENTION

Figure 1:
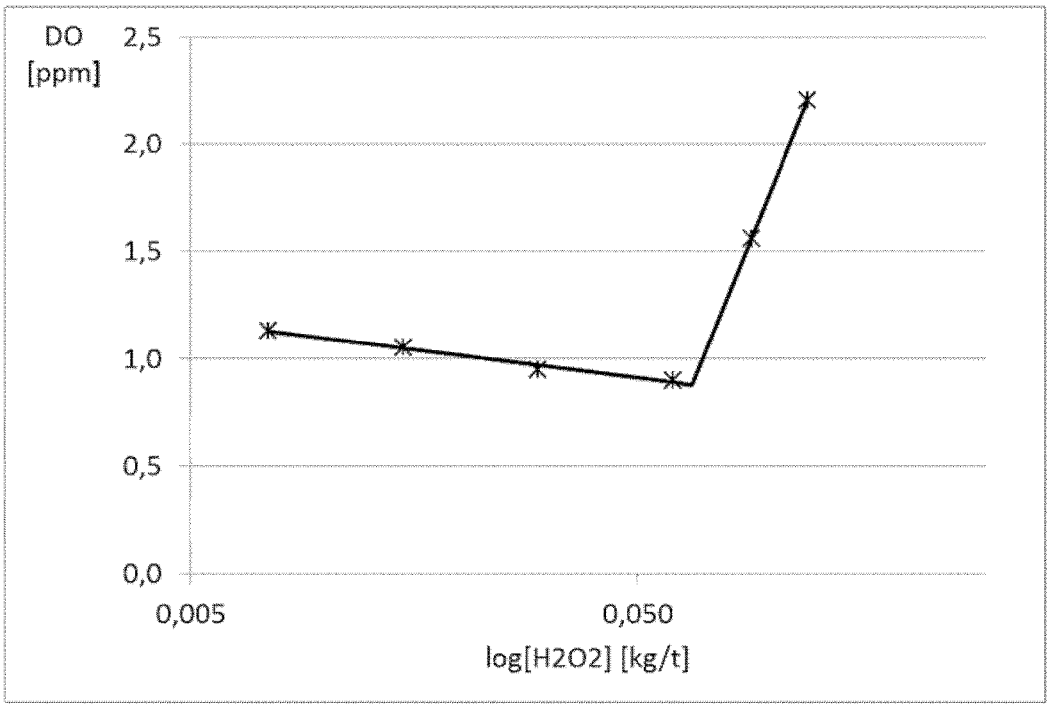
FIG. 1 shows the content of dissolved oxygen (DO) plotted against the logarithm of the amount of hydrogen peroxide added in the experiments of example 1.

The method of the invention recovers a copper sulfide concentrate from an ore containing an iron sulfide using three method steps.

In the first step of the method of the invention, the ore is ground with grinding media made of high chromium cast iron alloy with a chromium content of from 10 to 35% by weight, preferably 10-25% by weight, more preferably 15-21% by weight. Grinding can be carried out in any mill known from the art that uses grinding media. Suitable mills are ball mills using balls as grinding media or rod mills using rods as grinding media, with ball mills being preferred. The mill preferably has a lining of an abrasion resistant material. Most preferably, the mill has a lining of a high chromium cast iron alloy with a chromium content of from 10 to 35% by weight.

High chromium cast iron alloys suitable for the invention are known from the prior art. Preferably, the high chromium cast iron alloy is a high chromium white iron alloy comprising a carbide phase. More preferably, the high chromium cast iron alloy is a martensitic solid solution free from pearlite and comprising less than 5% by weight austenite, such as the high chromium cast iron alloys known from GB 1 218 981 and GB 1 315 203. Such phase compositions ensure high abrasion resistance of the grinding media. Grinding media suitable for the invention are available commercially from Magotteaux under the trade name Duromax®.

The ore is wet milled to form a mineral pulp, i.e. an aqueous suspension of ground ore. The ore may be fed to the mill together with water. Alternatively, ore and water are fed separately. Milling is carried out typically to a median particle size of 50-200 μm. Preferably, the ore is ground to what is called the liberation size, i.e. the maximum median particle size where essentially all copper sulfide is exposed to the particle surface and essentially no copper sulfide remains encapsulated inside a particle.

In the second step of the method of the invention, the ore is conditioned with a collector compound to form a conditioned mineral pulp. Collector compounds are compounds which after addition to the mineral pulp adsorb to the surface of copper sulfides and render the surface hydrophobic. Collector compounds suitable for froth flotation of copper sulfides are known from the prior art. Preferably, an alkali metal alkyl xanthate is used as collector, such as potassium amyl xanthate or sodium ethyl xanthate. Conditioning is typically carried out by adding the conditioner to the mineral pulp and mixing for a time period sufficient to achieve adsorption of the conditioner to the mineral surface, typically for less than 15 minutes. Preferably for 0.5 to 15 minutes. Alternatively, the collector is added in the first step of grinding and conditioning is carried out by retaining the mineral pulp for a corresponding time.

Further reagents, such as frothers, pH regulators, depressants and mixtures thereof may be added in the grinding step, the conditioning step or in both steps. Frothers are compounds that stabilize the froth formed in a froth flotation. Suitable frothers are commercially available, e.g. from Huntsman under the trade name POLYFROTH®. Depressants are compounds that render the surface of unwanted minerals more hydrophilic. Polyamines known from the prior art, such as diethylenetriamine or triethylenetetraamine, may be used as depressants for iron sulfides. pH regulators, such as calcium oxide, calcium hydroxide or sodium carbonate, may be added to adjust the pH of the mineral pulp to a desired value, preferably to a value in the range from 7 to 11.

In the third step of the method of the invention, the conditioned mineral pulp is subjected to froth flotation to form froth and a flotation tailing, with hydrogen peroxide being added to the conditioned mineral pulp during froth flotation or between the second step of conditioning the mineral pulp and the step of froth flotation. The froth is separated from the flotation tailing to recover a copper sulfide concentrate. Froth flotation may be carried out using equipment and procedures known to a person skilled in the art for the froth flotation of copper ores.

Froth flotation may be carried out as a single stage flotation or as a multiple stage flotation, using e.g. rougher, scavenger and cleaner stages. In a multiple stage froth flotation, hydrogen peroxide is preferably added before the first flotation stage or during the first flotation stage.

When hydrogen peroxide is added between the step of conditioning the mineral pulp and the step of froth flotation, the time period between addition of hydrogen peroxide and froth flotation is preferably less than 15 min, more preferably less than 3 min and most preferably less than 1 min. Limiting the time period between addition of hydrogen peroxide and froth flotation improves both concentrate grade and recovery of copper sulfides.

In a preferred embodiment of the method of the invention, froth flotation is carried out continuously and hydrogen peroxide is added continuously during froth flotation.

Hydrogen peroxide is preferably added as an aqueous solution comprising 0.5 to 5% by weight hydrogen peroxide. Adding such a dilute hydrogen peroxide solution provides better concentrate grade and recovery than obtained with the same amount of a more concentrated hydrogen peroxide solution. Therefore, it is preferred to dilute a commercial hydrogen peroxide solution comprising 30 to 70% by weight hydrogen peroxide to a dilute solution comprising 0.5 to 5% by weight hydrogen peroxide before adding it in the method of the invention.

The amount of hydrogen peroxide added to the conditioned pulp can be varied over a wide range depending on the ore composition. The method of the invention requires only small amounts of hydrogen peroxide. In general, less than 100 g hydrogen peroxide per ton of ore are needed and preferably less than 50 g/t are used. The method can be carried out with as little as 2 g/t hydrogen peroxide per ton of ore and preferably at least 5 g/t are used.

Usually there will be an optimum amount of hydrogen peroxide per ton of ore that depends on the ore composition. Increasing the amount of added hydrogen peroxide up to the optimum amount will lead to an increase in concentrate grade and recovery of copper sulfides, whereas increasing the amount of added hydrogen peroxide beyond the optimum amount will not lead to any further improvement, but in general will even lead to a reduced concentrate grade and recovery of copper sulfides.

A target amount of hydrogen peroxide that is close to the optimum amount of hydrogen peroxide can be determined by the following method without carrying out ore assays for determining concentrate grade and recovery of copper sulfides. A series of preliminary experiments is carried out in which varying amounts of hydrogen peroxide are added to the conditioned mineral pulp and the concentration of dissolved oxygen is determined in the mineral pulp after the addition of hydrogen peroxide. The concentration of dissolved oxygen is then plotted against the amount of added hydrogen peroxide to give a curve having an inflection point, and the target amount of hydrogen peroxide is determined as the amount of hydrogen peroxide at the inflection point. The method of the invention is preferably carried out using from 0.5 to 10 times the target amount, more preferably using from 0.5 to 2 times the target amount. Preferably, the concentration of dissolved oxygen is plotted against the logarithm of the amount of added hydrogen peroxide to give a curve having an essentially constant slope on both sides of the inflection point.

The concentration of dissolved oxygen in the mineral pulp can be determined with equipment known from the prior art. Preferred sensors for determining the concentration of dissolved oxygen are amperometric sensors or optical sensors that measure oxygen concentration by electrochemical reduction of oxygen or by oxygen caused fluorescence quenching of a dye. The sensor preferably has an oxygen permeable membrane on the oxygen sensing device, which membrane has low permeability for hydrogen peroxide.

For the method of the invention, where grinding media of high chromium cast iron alloy are used, the curve of the concentration of dissolved oxygen plotted against the logarithm of the amount of added hydrogen peroxide usually has a minimum at the inflection point. This property is used in a preferred embodiment of the method of the invention, where the concentration of dissolved oxygen is determined in the mineral pulp after addition of hydrogen peroxide and the amount of hydrogen peroxide added is adjusted to maintain a minimum concentration of dissolved oxygen. Such adjusting can conveniently be done either regularly or when a change in ore composition has occurred by varying the amount of hydrogen peroxide added while measuring the concentration of dissolved oxygen after addition of hydrogen peroxide and continuing such variations in the direction where a lower concentration of dissolved oxygen is achieved until a minimum concentration of dissolved oxygen is reached.

The method of the invention provides an unexpected improvement in the concentrate grade and recovery of copper sulfides in the obtained copper sulfide concentrate, which is higher than what a person skilled in the art would expect from the individual effect known for using grinding media of high chromium cast iron alloy instead of grinding media of forged carbon steel and the effect observed for adding hydrogen peroxide to a mineral pulp obtained by wet milling with grinding media of forged carbon steel. Furthermore, the use of grinding media of high chromium cast iron alloy for wet grinding the ore substantially reduces the amount of hydrogen peroxide needed for achieving an optimum concentrate grade and recovery of copper sulfides and thereby reduces the total amount of chemicals needed for recovering copper sulfides by froth flotation.

In addition to providing an improvement in the concentrate grade and recovery of copper sulfides, the method of the invention can also provide an improved recovery of gold from the ore and reduce the content of iron sulfides and arsenic minerals in the copper sulfide concentrate.

The inventors of the current invention have also realized, that the redox potential of the mineral pulp, which has been used in the prior art for controlling addition of an oxidant in a froth flotation process, cannot be used to control or adjust hydrogen peroxide addition in the method of the invention. They have further found that the concentration of dissolved oxygen after addition of hydrogen peroxide is a suitable parameter for adjusting the amount of hydrogen peroxide used in the method of the invention, which parameter has not been identified in the prior art.

The following examples illustrate the invention, but are not intended to limit the scope of the invention.

EXAMPLES

In all flotation experiments, ores were ground to a particle size P80 of 200 μm with a laboratory MAGOTTEAUX MILL® using 16*1 inch rods as grinding media. The resulting mineral pulp was transferred to a laboratory flotation cell and mixed for two minutes to homogenize. Sodium ethyl xanthate was added as collector at 21 g per ton of ore, followed by 5 g per ton of POLYFROTH® H27frother from Huntsman. The resulting mineral pulp was conditioned for 1 min before flotation was started by introducing air. Four timed concentrates were collected during flotation over intervals given in the examples. Each concentrate was collected by hand scraping the froth from the surface of the pulp once every 10 seconds. Concentrates were weighed and assayed and cumulated grades and recoveries were calculated from these data. Grades were plotted against recovery and the values for grades at a specific copper recovery and recoveries at a specific copper grade given in the tables below were read from these curves.

Examples 1 to 6

Flotation was carried out with a sedimentary copper/gold ore having a head assay of 1.74% Cu, 9.95% Fe, 3.27 ppm Au, 168 ppm Bi, and 3.21% S.

In examples 1 and 2, preliminary experiments were carried out using varying amounts of hydrogen peroxide that were added immediately before starting flotation and the redox potential (Eh) and the content of dissolved oxygen (DO) were determined immediately after flotation was started. In example 1, the ore was ground with grinding media made of forged carbon steel. In example 2, the ore was ground with grinding media made of high chromium cast iron alloy with a chromium content of 15% by weight. The results are summarized in table 1. No significant change of redox potential upon hydrogen peroxide addition was observed for the mineral pulp ground with high chromium cast iron alloy grinding media.

Figure 2:
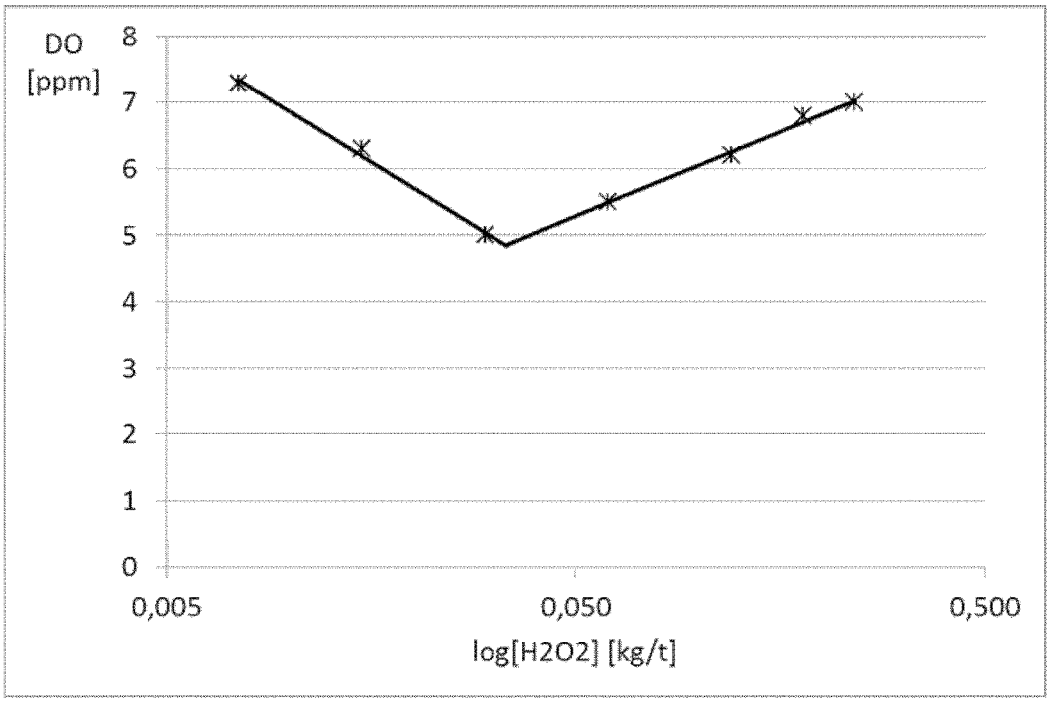
FIG. 2 shows DO plotted against the logarithm of the amount of hydrogen peroxide added in the experiments of example 2.

FIG. 1 shows a curve of DO plotted against the logarithm of the amount of added hydrogen peroxide for example 1. The curve of FIG. 1 shows an inflection point for a hydrogen peroxide amount of about 66 g/t, with DO slightly decreasing upon addition of smaller amounts and DO rapidly increasing upon addition of larger amounts. FIG. 2 shows the corresponding curve for example 2 with an inflection point at about 34 g/t with DO decreasing upon addition of smaller amounts and DO increasing upon addition of larger amounts.

TABLE 1

| Variation of added hydrogen peroxide amount | | | | |
|---|---|---|---|---|
| $H_2O_2$ added | Example 1* forged carbon steel | | Example 2 high Cr cast iron alloy | |
| [g/t] | DO [ppm] | Eh [mV] | DO [ppm] | Eh [mV] |
| 0 | 1.13 | 241 | 7.25 | 258 |
| 7.5 | 1.13 | 230 | 7.30 | 256 |
| 15 | 1.05 | 220 | 6.30 | 254 |
| 30 | 0.95 | 226 | 5.00 | 252 |
| 60 | 0.90 | 222 | 5.50 | 254 |
| 90 | 1.56 | 227 | | |
| 120 | 2.20 | 239 | 6.2 | 252 |
| 180 | | | 6.80 | 248 |
| 240 | | | 7.00 | 252 |

*Not according to the invention

In examples 3 to 6, flotation was carried out with concentrates collected over intervals of 0.5, 2, 5, and 10 minutes. In examples 3 and 4, the ore was ground with grinding media made of forged carbon steel and in examples 5 and 6, the ore was ground with grinding media of high chromium cast iron alloy with a chromium content of 15% by weight. No hydrogen peroxide was added in examples 3 and 5. In example 4, a 1% by weight aqueous hydrogen peroxide solution was added in an amount of 75 g/t ore immediately before starting flotation. In example 6, the same aqueous hydrogen peroxide solution was added in an amount of 30 g/t ore immediately before starting flotation.

Figure 3:
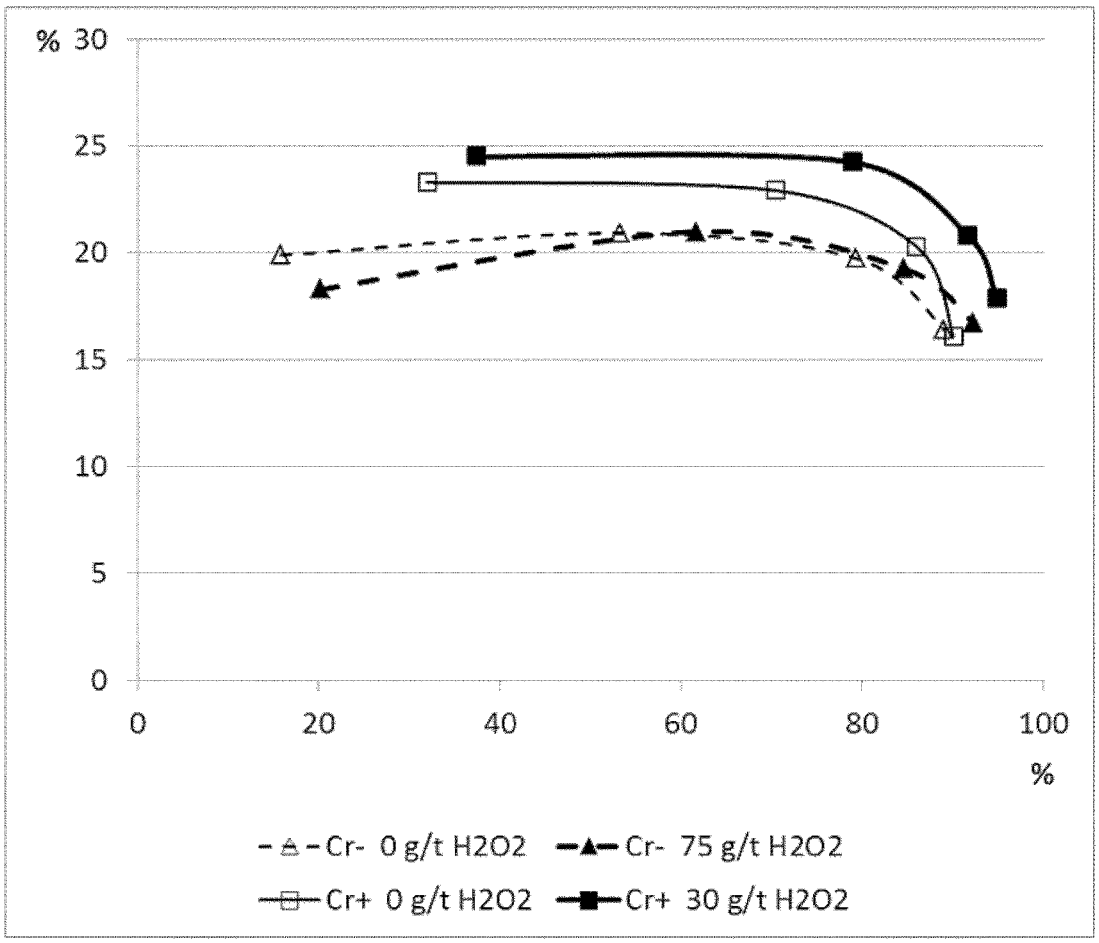
FIG. 3 shows curves for cumulated copper concentrate grade (y-axis) plotted against cumulated copper recovery (x-axis) for examples 3 to 6, with Cr− denoting the use of forged carbon steel grinding media and Cr+ denoting the use of high chromium cast iron alloy grinding media.

FIG. 3 shows the curves for cumulated copper concentrate grade plotted against cumulated copper recovery for examples 3 to 6, with Cr− denoting the use of forged carbon steel grinding media and Cr+denoting the use of high chromium cast iron alloy grinding media. Tables 2 and 3 compare these results at 85% copper recovery and at 18% concentrate copper grade.

TABLE 2

| Copper and gold concentrate grades and gold and diluent recoveries at 85% copper recovery | | | | | | | |
|---|---|---|---|---|---|---|---|
| | Grinding | Grade | | Recovery | | | |
| Example | media, $H_2O_2$ added | Cu [%] | Au [ppm] | Au [%] | Bi [%] | IS [%] | NSG [%] |
| 3* | Forged carbon steel, 0 g/t | 18.2 | 25.0 | 62.5 | 69.2 | 18.8 | 3.6 |
| 4* | Forged carbon steel 75 g/t | 19.2 | 26.0 | 55.0 | 65.0 | 13.6 | 3.4 |
| 5* | High Cr cast iron alloy 0 g/t | 20.6 | 29.2 | 55.8 | 38.9 | 11.8 | 1.8 |
| 6 | High Cr cast iron alloy 30 g/t | 23.2 | 27.2 | 57.5 | 60.0 | 4.8 | 2.2 |

*Not according to the invention,
IS = iron sulfides,
NSG = non sulfide gangue

TABLE 3

| Copper and gold recovery and concentrate gold and diluents grade at 18% concentrate copper grade | | | | | | | |
|---|---|---|---|---|---|---|---|
| | Grinding | Recovery | | Grade | | | |
| Example | media, $H_2O_2$ added | Cu [%] | Au [%] | Au [ppm] | Bi [ppm] | IS [%] | NSG [%] |
| 3* | Forged carbon steel, 0 g/t | 85.7 | 58.8 | 24.7 | 1420 | 6.2 | 41.5 |
| 4* | Forged carbon steel 75 g/t | 89.3 | 63.3 | 24.7 | 1310 | 4.7 | 42.8 |
| 5* | High Cr cast iron alloy 0 g/t | 88.8 | 60.3 | 26.2 | 1260 | 6.2 | 41.5 |
| 6 | High Cr cast iron alloy 30 g/t | 94.8 | 70.7 | 23.3 | 1280 | 4.3 | 43.4 |

*Not according to the invention,
IS = iron sulfides,
NSG = non sulfide gangue

The data of table 2 show a synergistic improvement in copper concentrate grade and in the selectivity for copper sulfides over iron sulfides for the method of the invention compared to using only hydrogen peroxide or using only high chromium grinding media. Table 3 shows a similar synergistic improvement in the recovery of copper and gold.

Examples 7 to 13

Flotation was carried out with a volcanogenic sulfide deposit ore having a head assay of 2.63% Cu, 19.2% Fe, and 15.9% S.

In examples 7 and 8, preliminary experiments were carried out using varying amounts of hydrogen peroxide that were added immediately before starting flotation and the redox potential (Eh) and the content of dissolved oxygen (DO) were determined immediately after flotation was started. In example 7, the ore was ground with grinding media made of forged carbon steel. In example 8, the ore was ground with grinding media made of high chromium cast iron alloy with a chromium content of 21% by weight. The results are summarized in table 4. No significant change of redox potential upon hydrogen peroxide addition was observed for the mineral pulp ground with high chromium cast iron alloy grinding media.

Figure 4:
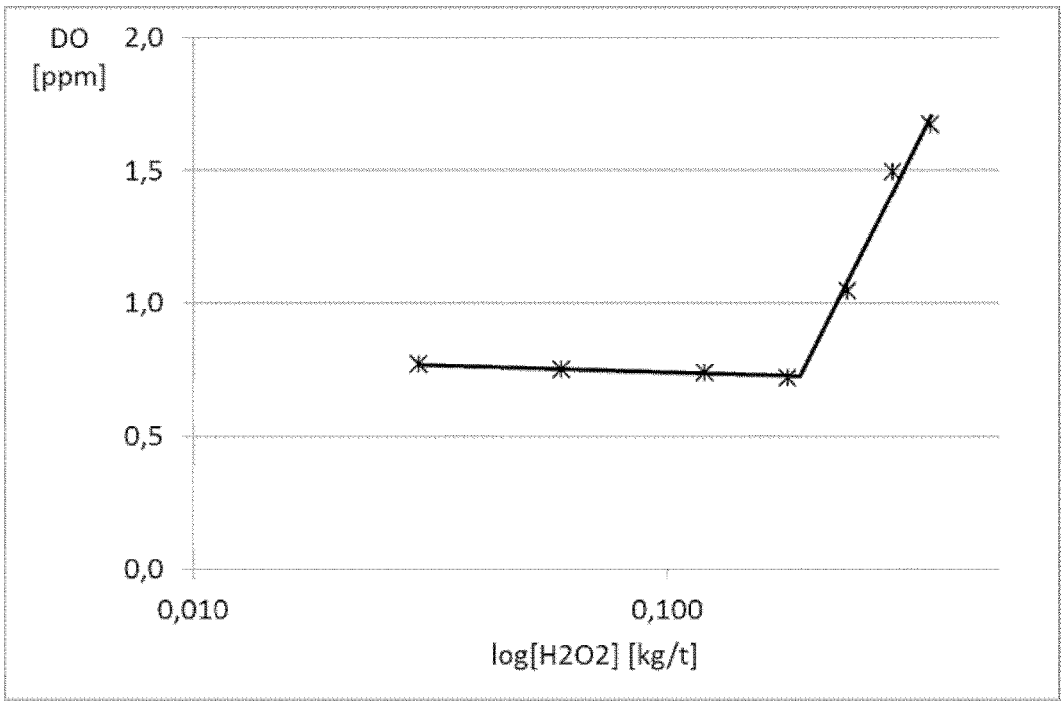
FIG. 4 shows DO plotted against the logarithm of the amount of hydrogen peroxide added in the experiments of example 7.
Figure 5:
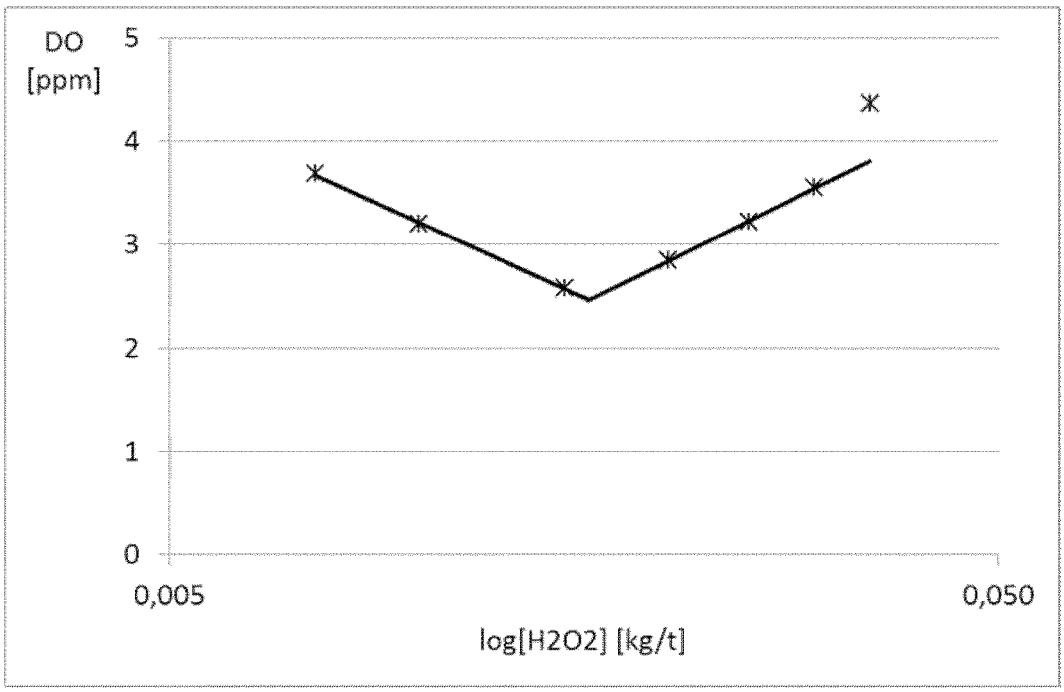
FIG. 5 shows DO plotted against the logarithm of the amount of hydrogen peroxide added in the experiments of example 8.

FIG. 4 shows a curve of DO plotted against the logarithm of the amount of added hydrogen peroxide for example 7. The curve of FIG. 4 shows an inflection point for a hydrogen peroxide amount of about 190 g/t with no significant change of DO upon addition of smaller amounts and DO rapidly increasing upon addition of larger amounts. FIG. 5 shows the corresponding curve for example 2 with an inflection point at about 16 g/t with DO decreasing upon addition of smaller amounts and DO increasing upon addition of larger amounts.

TABLE 4

| Variation of added hydrogen peroxide amount | | | | |
|---|---|---|---|---|
| $H_2O_2$ added | Example 7* forged carbon steel | | Example 8 high Cr cast iron alloy | |
| [g/t] | DO [ppm] | Eh [mV] | DO [ppm] | Eh [mV] |
| 0 | 0.74 | 250 | 3.63 | 258 |
| 7.5 | | | 3.69 | 256 |
| 10 | | | 3.20 | 254 |

TABLE 4-continued

| Variation of added hydrogen peroxide amount | | | | |
|---|---|---|---|---|
| $H_2O_2$ added | Example 7* forged carbon steel | | Example 8 high Cr cast iron alloy | |
| [g/t] | DO [ppm] | Eh [mV] | DO [ppm] | Eh [mV] |
| 15 | | | 2.58 | 252 |
| 20 | | | 2.85 | 254 |
| 25 | | | 3.23 | 252 |
| 30 | 0.77 | 243 | 3.55 | 248 |
| 35 | | | 4.36 | 252 |
| 60 | 0.75 | 237 | | |
| 120 | 0.74 | 239 | | |
| 180 | 0.72 | 235 | | |
| 240 | 1.05 | 236 | | |
| 300 | 1.49 | 240 | | |
| 360 | 1.67 | 245 | | |

*Not according to the invention

In examples 9 to 13, flotation was carried out with concentrates collected over intervals of 0.5, 2, 4, and 7 minutes. In examples 9 to 11, the ore was ground with grinding media made of forged carbon steel and in examples 12 and 13, the ore was ground with grinding media of high chromium cast iron alloy with a chromium content of 21% by weight. No hydrogen peroxide was added in examples 9 and 12. In examples 10 and 11, a 1% by weight aqueous hydrogen peroxide solution was added in amounts of 15 g/t ore and 240 g/t ore immediately before starting flotation. In example 13, the same aqueous hydrogen peroxide solution was added in an amount of 15 g/t ore immediately before starting flotation.

Figure 6:
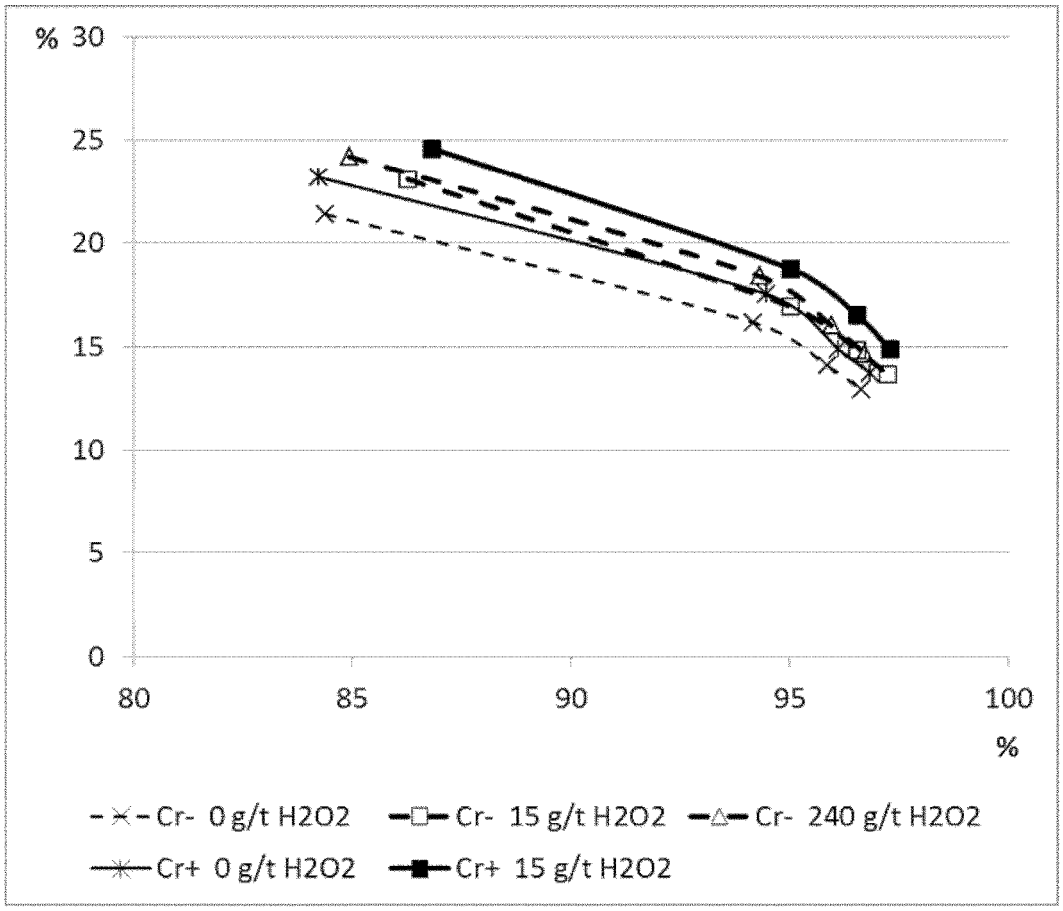
FIG. 6 shows curves for cumulated copper concentrate grade plotted against cumulated copper recovery for examples 9 to 13, with Cr− denoting the use of forged carbon steel grinding media and Cr+ denoting the use of high chromium cast iron alloy grinding media.

FIG. 6 shows the curves for cumulated copper concentrate grade plotted against cumulated copper recovery for examples 9 to 13, with Cr− denoting the use of forged carbon steel grinding media and Cr+ denoting the use of high chromium cast iron alloy grinding media. Tables 5 and 6 compare these results at 90% copper recovery and at 18% concentrate copper grade.

The data of tables 5 and 6 show that the method of the invention requires less hydrogen peroxide for achieving high copper recovery and concentrate grade than flotation of an ore ground with forged carbon steel.

TABLE 5

| Copper and iron concentrate grades and diluent recoveries at 90% copper recovery | | | | | | |
|---|---|---|---|---|---|---|
| | Grinding | Grade | | Recovery | | |
| Example | media, $H_2O_2$ added | Cu [%] | Fe [%] | Fe [%] | IS [%] | NSG [%] |
| 9* | Forged carbon steel, 0 g/t | 15.5 | 26.8 | 18.2 | 10.0 | 4.5 |
| 10* | Forged carbon steel 15 g/t | 20.5 | 28.8 | 17.7 | 7.7 | 4.1 |
| 11* | Forged carbon steel 240 g/t | 21.1 | 27.6 | 16.4 | 8.0 | 3.9 |
| 12* | High Cr cast iron alloy 0 g/t | 20.1 | 26.7 | 16.6 | 7.7 | 4.7 |
| 13 | High Cr cast iron alloy 15 g/t | 22.3 | 27.8 | 15.6 | 6.6 | 3.7 |

*Not according to the invention,
IS = iron sulfides,
NSG = non sulfide gangue

TABLE 6

| Copper and iron recovery and concentrate diluents grade at 18% concentrate copper grade | | | | | | |
|---|---|---|---|---|---|---|
| | Grinding | Recovery | | Grade | | |
| Example | media, $H_2O_2$ added | Cu [%] | Fe [%] | Fe [%] | IS [%] | NSG [%] |
| 9* | Forged carbon steel, 0 g/t | 91.0 | 18.8 | 26.8 | 19.0 | 28.4 |
| 10* | Forged carbon steel 15 g/t | 93.5 | 20.2 | 28.1 | 18.0 | 26.4 |
| 11* | Forged carbon steel 240 g/t | 94.6 | 19.5 | 26.9 | 20.0 | 27.5 |
| 12* | High Cr cast iron alloy 0 g/t | 93.8 | 18.7 | 26.2 | 17.7 | 29.7 |
| 13 | High Cr cast iron alloy 15 g/t | 95.6 | 19.4 | 26.7 | 18.8 | 28.7 |

*Not according to the invention,
IS = iron sulfides,
NSG = non sulfide gangue

Examples 14 to 18

Flotation was carried out with a porphyry copper/gold ore having a head assay of 0.43% Cu, 5.4% Fe, 0.18 ppm Au and 5.0% S.

In example 14, a preliminary experiment was carried out with the ore ground with grinding media made of forged carbon steel, using varying amounts of hydrogen peroxide that were added immediately before starting flotation, and the redox potential (Eh) and the content of dissolved oxygen (DO) were determined immediately after flotation was started. The results are summarized in table 7.

TABLE 7

| Variation of added hydrogen peroxide amount | | |
|---|---|---|
| $H_2O_2$ added | Example 14* forged carbon steel | |
| [g/t] | DO [ppm] | Eh [mV] |
| 0 | 0.40 | 224 |
| 7.5 | 0.40 | 203 |
| 15 | 0.30 | 186 |
| 30 | 0.30 | 199 |
| 60 | 0.30 | 190 |
| 120 | 0.45 | 201 |
| 180 | 0.75 | 210 |
| 240 | 1.00 | 225 |

*Not according to the invention

Figure 7:
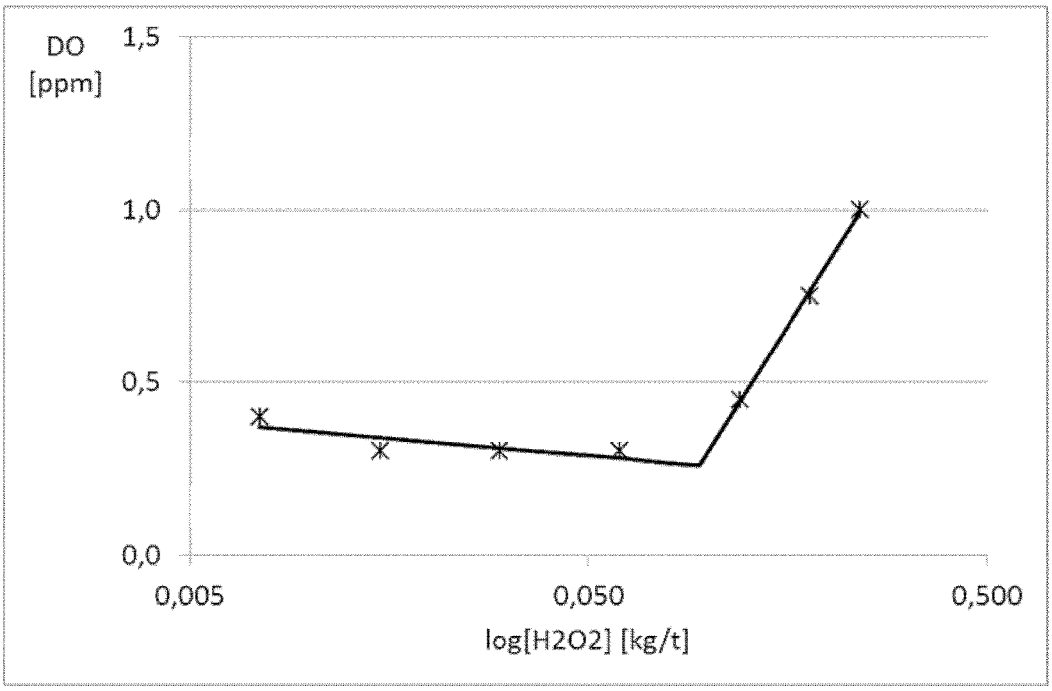
FIG. 7 shows DO plotted against the logarithm of the amount of hydrogen peroxide added in the experiments of example 14.

FIG. 7 shows a curve of DO plotted against the logarithm of the amount of added hydrogen peroxide for example 14. The curve of FIG. 7 shows an inflection point for a hydrogen peroxide amount of about 95 g/t with no significant change of DO upon addition of smaller amounts and DO rapidly increasing upon addition of larger amounts.

In examples 15 to 18, flotation was carried out with concentrates collected over intervals of 0.5, 2, 4, and 9 minutes. In examples 15 and 16, the ore was ground with grinding media made of forged carbon steel and in examples 17 and 18, the ore was ground with grinding media of high chromium cast iron alloy with a chromium content of 18% by weight. No hydrogen peroxide was added in examples 15 and 17. In examples 16 and 18, a 1% by weight aqueous hydrogen peroxide solution was added in an amount of 120 g/t ore immediately before starting flotation.

Figure 8:
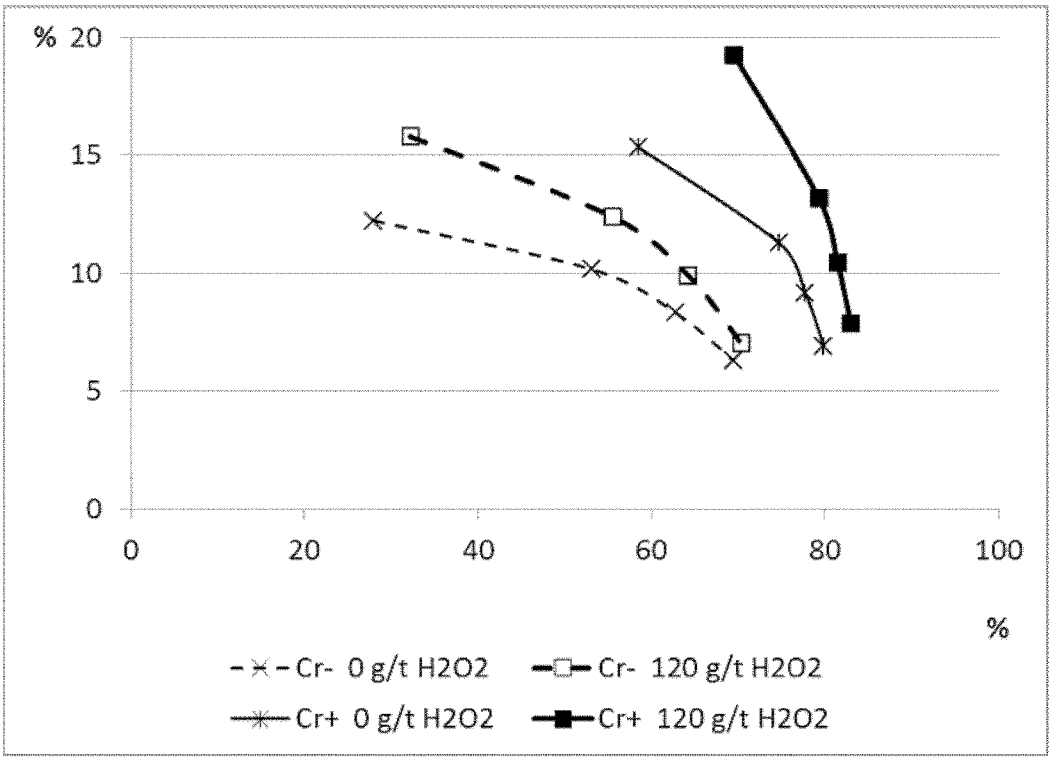
FIG. 8 shows curves for cumulated copper concentrate grade plotted against cumulated copper recovery for examples 15 to 18, with Cr− denoting the use of forged carbon steel grinding media and Cr+ denoting the use of high chromium cast iron alloy grinding media.

FIG. 8 shows the curves for cumulated copper concentrate grade plotted against cumulated copper recovery for examples 15 to 18, with Cr− denoting the use of forged carbon steel grinding media and Cr+ denoting the use of high chromium cast iron alloy grinding media. Tables 8 and 9 compare these results at 70% copper recovery and at 9% concentrate copper grade.

TABLE 8

Copper and gold concentrate grades and gold and diluent recoveries at 70% copper recovery

| Example | Grinding media, $H_2O_2$ added | Grade Cu [%] | Grade Au [ppm] | Recovery Au [%] | Recovery IS [%] | Recovery NSG [%] |
|---|---|---|---|---|---|---|
| 15* | Forged carbon steel, 0 g/t | 6.2 | 1.3 | 35.0 | 14.5 | 3.1 |
| 16* | Forged carbon steel 120 g/t | 7.2 | 1.7 | 46.0 | 11.2 | 2.6 |
| 17* | High Cr cast iron alloy 0 g/t | 12.6 | 2.7 | 40.0 | 10.6 | 0.7 |
| 18 | High Cr cast iron alloy 120 g/t | 18.9 | 3.2 | 31.0 | 3.7 | 0.5 |

*Not according to the invention,
IS = iron sulfides,
NSG = non sulfide gangue

TABLE 9

Copper and gold recovery and concentrate gold and diluents grade at 9% concentrate copper grade

| Example | Grinding media, $H_2O_2$ added | Recovery Cu [%] | Recovery Au [%] | Grade Au [ppm] | Grade IS [%] | Grade NSG [%] |
|---|---|---|---|---|---|---|
| 15* | Forged carbon steel, 0 g/t | 60.0 | 27.5 | 1.7 | 33.0 | 41.0 |
| 16* | Forged carbon steel 120 g/t | 67.0 | 42.5 | 2.0 | 27.0 | 47.0 |
| 17* | High Cr cast iron alloy 0 g/t | 77.5 | 48.0 | 2.2 | 34.5 | 38.0 |
| 18 | High Cr cast iron alloy 120 g/t | 82.0 | 49.0 | 2.1 | 22.0 | 52.5 |

*Not according to the invention,
IS = iron sulfides,
NSG = non sulfide gangue

The data of table 8 show a synergistic improvement in copper grade and in the selectivity for copper sulfides over iron sulfides for the method of the invention compared to using only hydrogen peroxide or using only high chromium grinding media. Table 9 shows a further improvement in the recovery of copper and gold.

Examples 19 to 23

Flotation was carried out with an iron oxide hosted copper/gold ore having a head assay of 0.83% Cu, 21.7% Fe, 0.39 ppm Au, 568 ppm As, and 4.0% S.

In example 19, a preliminary experiment was carried out with the ore ground with grinding media made of forged carbon steel, using varying amounts of hydrogen peroxide that were added immediately before starting flotation, and the redox potential (Eh) and the content of dissolved oxygen (DO) were determined immediately after flotation was started. The results are summarized in table 10.

TABLE 10

Variation of added hydrogen peroxide amount

| $H_2O_2$ added [g/t] | Example 19* forged carbon steel DO [ppm] | Example 19* forged carbon steel Eh [mV] |
|---|---|---|
| 0 | 0.55 | 233 |
| 7.5 | 0.60 | 216 |
| 15 | 0.68 | 203 |
| 30 | 0.63 | 200 |
| 60 | 0.65 | 206 |
| 90 | 1.15 | 214 |
| 120 | 1.57 | 224 |

*Not according to the invention

Figure 9:
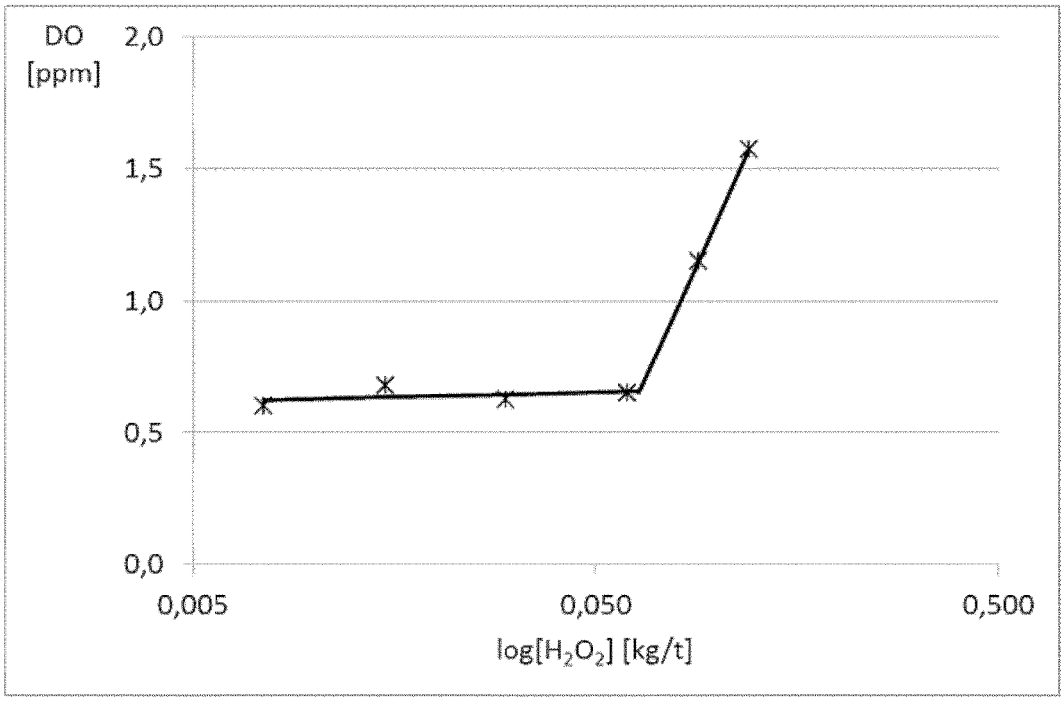
FIG. 9 shows DO plotted against the logarithm of the amount of hydrogen peroxide added in the experiments of example 19.

FIG. 9 shows a curve of DO plotted against the logarithm of the amount of added hydrogen peroxide for example 19. The curve of FIG. 9 shows an inflection point for a hydrogen peroxide amount of about 64 g/t with no significant change of DO upon addition of smaller amounts and DO rapidly increasing upon addition of larger amounts.

In examples 20 to 23, flotation was carried out with concentrates collected over intervals of 0.5, 2, 4, and 8 minutes. In examples 20 and 21 the ore was ground with grinding media made of forged carbon steel and in examples 22 and 23 the ore was ground with grinding media of high chromium cast iron alloy with a chromium content of 18% by weight. No hydrogen peroxide was added in examples 20 and 22. In examples 21 and 23 a 1% by weight aqueous hydrogen peroxide solution was added in an amount of 50 g/t ore immediately before starting flotation.

Figure 10:
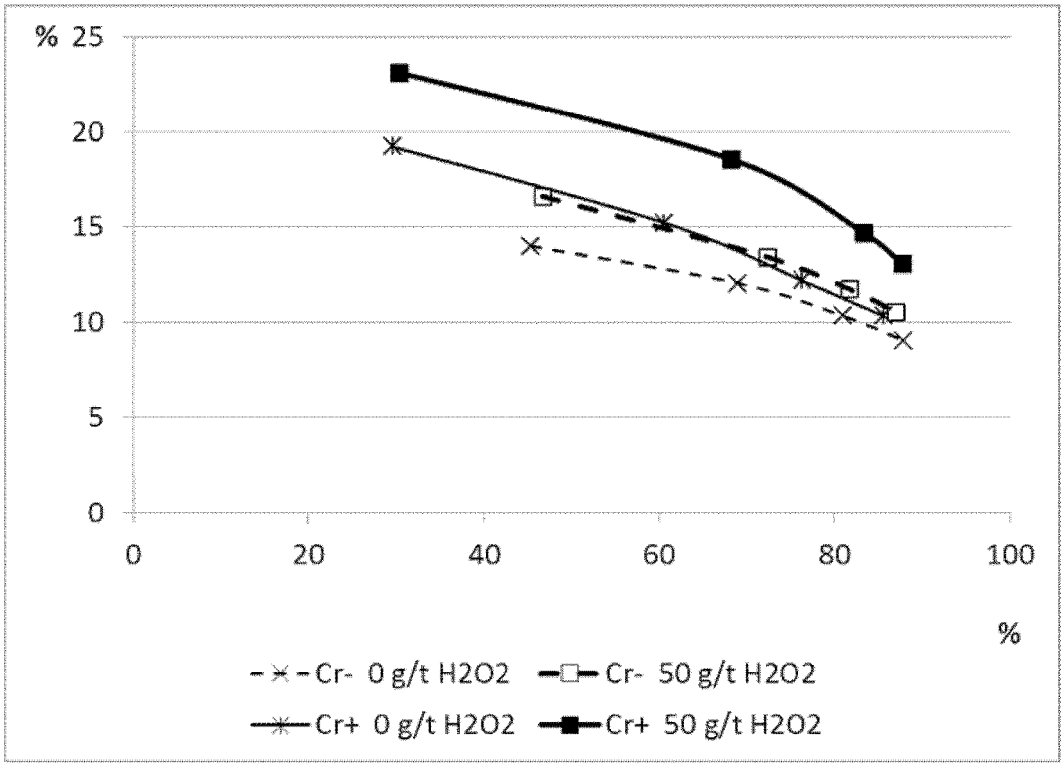
FIG. 10 shows curves for cumulated copper concentrate grade plotted against cumulated copper recovery for examples 20 to 23, with Cr− denoting the use of forged carbon steel grinding media and Cr+ denoting the use of high chromium cast iron alloy grinding media.

FIG. 10 shows the curves for cumulated copper concentrate grade plotted against cumulated copper recovery for examples 20 to 23, with Cr− denoting the use of forged carbon steel grinding media and Cr+denoting the use of high chromium cast iron alloy grinding media. Tables 11 and 12 compare these results at 80% copper recovery and at 13% concentrate copper grade.

TABLE 11

Copper and gold concentrate grades and gold and diluent recoveries at 80% copper recovery

| Example | Grinding media, $H_2O_2$ added | Grade Cu [%] | Grade Au [ppm] | Recovery Au [%] | Recovery As [%] | Recovery IS [%] | Recovery NSG [%] |
|---|---|---|---|---|---|---|---|
| 20* | Forged carbon steel, 0 g/t | 10.5 | 3.7 | 60.0 | 33.9 | 46.3 | 1.8 |
| 21* | Forged carbon steel 50 g/t | 12.0 | 3.9 | 59.0 | 27.5 | 38.0 | 1.4 |
| 22* | High Cr cast iron alloy 0 g/t | 11.5 | 4.0 | 51.5 | 22.8 | 34.9 | 2.0 |

TABLE 11-continued

Copper and gold concentrate grades and gold and diluent recoveries at 80% copper recovery

| Example | Grinding media, $H_2O_2$ added | Grade Cu [%] | Grade Au [ppm] | Recovery Au [%] | Recovery As [%] | Recovery IS [%] | Recovery NSG [%] |
|---|---|---|---|---|---|---|---|
| 23 | High Cr cast iron alloy 50 g/t | 15.7 | 4.4 | 46.6 | 10.3 | 10.1 | 1.7 |

*Not according to the invention,
IS = iron sulfides,
NSG = non sulfide gangue

TABLE 12

Copper and gold recovery and concentrate gold and diluents grade at 13% concentrate copper grade

| Example | Grinding media, $H_2O_2$ added | Recovery Cu [%] | Recovery Au [%] | Grade Au [ppm] | Grade As [ppm] | Grade IS [%] | Grade NSG [%] |
|---|---|---|---|---|---|---|---|
| 20* | Forged carbon steel, 0 g/t | 57.5 | 36.0 | 3.8 | 2740 | 42.8 | 19.1 |
| 21* | Forged carbon steel 50 g/t | 75.0 | 53.0 | 4.0 | 2780 | 41.8 | 20.1 |
| 22* | High Cr cast iron alloy 0 g/t | 72.5 | 43.0 | 4.2 | 2070 | 33.9 | 28.1 |
| 23 | High Cr cast iron alloy 50 g/t | 87.7 | 61.5 | 4.4 | 1400 | 15.8 | 46.1 |

*Not according to the invention,
IS = iron sulfides,
NSG = non sulfide gangue

The data of table 11 show a synergistic improvement in copper concentrate grade and in the selectivity for copper sulfides over iron sulfides and arsenic minerals for the method of the invention compared to using only hydrogen peroxide or using only high chromium grinding media. Table 12 shows a similar synergistic improvement in the recovery of copper and gold.

Examples 24 to 27

Flotation was carried out with a volcanogenic sulfide deposit ore having a head assay of 2.65% Cu, 19.6% Fe, and 16.1% S, which ore was similar to the ore used in examples 7 to 13.

In examples 24 to 27, the ore was ground with grinding media of high chromium cast iron alloy with a chromium content of 21% by weight. Flotation was carried out with concentrates collected over intervals of 0.5, 2, 4, and 7 minutes. No hydrogen peroxide was added in example 24. In examples 25 to 27, a 1% by weight aqueous hydrogen peroxide solution was added to the conditioned mineral pulp in an amount of 15 g/t ore. In example 25, flotation was started immediately after hydrogen peroxide addition, whereas in examples 26 and 27, the ore was conditioned with hydrogen peroxide by starting flotation 15 and 60 minutes after hydrogen peroxide addition.

Figure 11:
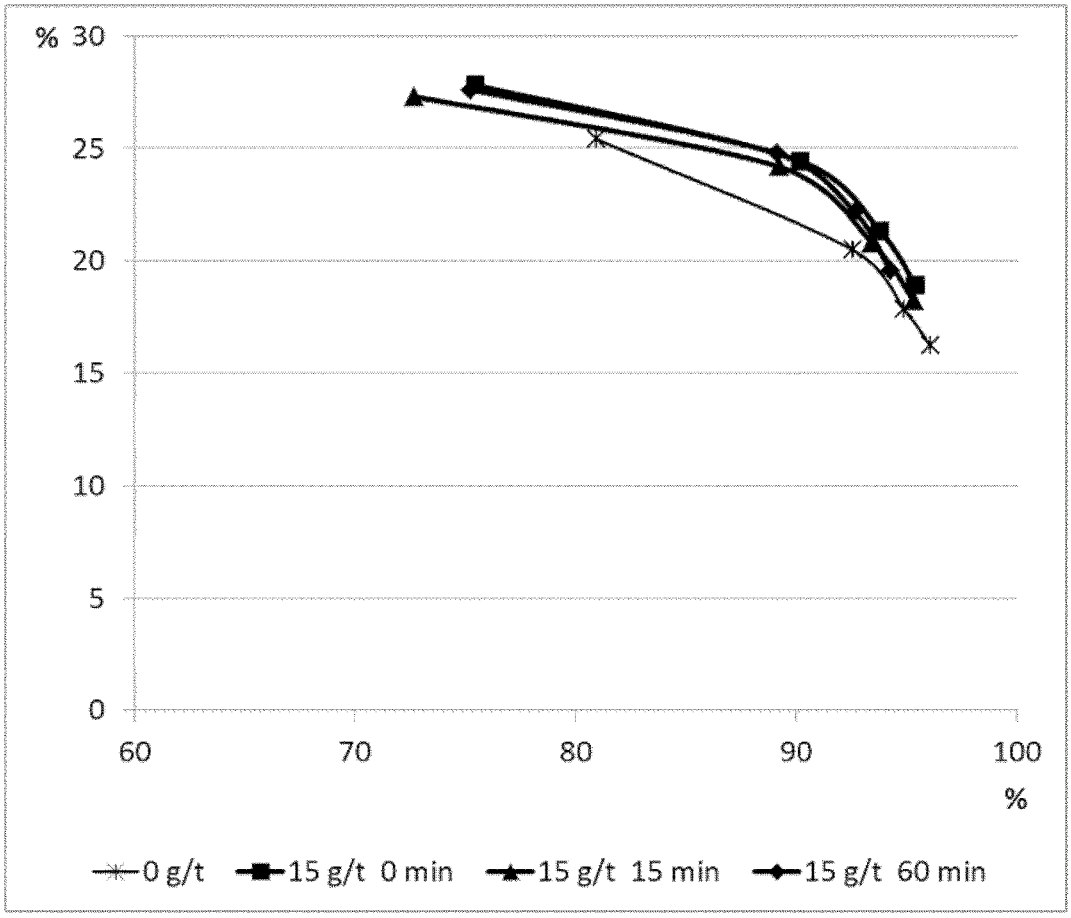
FIG. 11 shows curves for cumulated copper concentrate grade plotted against cumulated copper recovery for examples 24 to 27.

FIG. 11 shows the curves for cumulated copper concentrate grade plotted against cumulated copper recovery for examples 24 to 27. Tables 13 and 14 compare these results at 94% copper recovery and at 20% concentrate copper grade.

TABLE 13

Copper and iron concentrate grades and diluent recoveries at 94% copper recovery

| Example | $H_2O_2$ added, conditioning time | Grade Cu [%] | Grade Fe [%] | Recovery Fe [%] | Recovery IS [%] | Recovery NSG [%] |
|---|---|---|---|---|---|---|
| 24* | 0 g/t | 19.2 | 27.0 | 18.0 | 10.4 | 4.8 |
| 25 | 15 g/t, 0 min | 21.1 | 28.0 | 17.1 | 10.8 | 4.8 |
| 26 | 15 g/t, 15 min | 20.1 | 26.3 | 16.1 | 11.4 | 5.1 |
| 27 | 15 g/t, 60 min | 20.0 | 25.8 | 15.7 | 11.8 | 5.2 |

*Not according to the invention,
IS = iron sulfides,
NSG = non sulfide gangue

TABLE 14

Copper and iron recovery and concentrate diluents grade at 20% concentrate copper grade

| Example | $H_2O_2$ added, conditioning time | Recovery Cu [%] | Recovery Fe [%] | Grade Fe [%] | Grade IS [%] | Grade NSG [%] |
|---|---|---|---|---|---|---|
| 24* | 0 g/t | 93.3 | 17.2 | 27.2 | 18.8 | 25.1 |
| 25 | 15 g/t, 0 min | 94.7 | 18.0 | 27.5 | 23.2 | 29.3 |
| 26 | 15 g/t, 15 min | 94.2 | 15.3 | 26.3 | 23.2 | 29.3 |
| 27 | 15 g/t, 60 min | 94.0 | 15.8 | 25.8 | 23.2 | 29.3 |

*Not according to the invention,
IS = iron sulfides,
NSG = non sulfide gangue

The data of tables 13 and 14 show that the method of the invention provides the best results if there is no or only a short delay between the addition of hydrogen peroxide and the flotation step. However, even when the ore is conditioned with hydrogen peroxide, the method of the invention still provides an improvement over a method using grinding media made of high chromium cast iron alloy and no hydrogen peroxide.

The invention claimed is:

1. A method for recovering a copper sulfide concentrate from an ore containing an iron sulfide, comprising the steps of:

a) wet grinding the ore with grinding media to form a mineral pulp, b) conditioning the mineral pulp with a collector compound to form a conditioned mineral pulp, and c) froth flotation of the conditioned mineral pulp to form a froth and a flotation tailing, separating the froth from the flotation tailing to recover the copper sulfide concentrate, wherein the grinding media comprise grinding media made of high chromium cast iron alloy with a chromium content of from 10 to 35% by weight and hydrogen peroxide is added to the conditioned mineral pulp between steps b) and c) or during step c).

2. The method of claim 1, wherein the grinding media are high chromium cast iron alloy balls.

3. The method of claim 1, wherein the high chromium cast iron alloy is a high chromium white iron alloy comprising a carbide phase.

4. The method of claim 1, wherein the high chromium cast iron alloy is a martensitic solid solution free from pearlite and comprising less than 5% by weight austenite.

5. The method of claim 1, wherein the hydrogen peroxide is added less than 15 minutes before a gas is introduced for froth flotation.

6. The method of claim 1, wherein froth flotation is carried out continuously and hydrogen peroxide is added continuously during froth flotation.

7. The method of claim 1, wherein hydrogen peroxide is added as an aqueous solution comprising 0.5 to 5% by weight hydrogen peroxide.

8. The method of claim 1, wherein the collector compound is an alkali metal alkyl xanthate.

9. The method of claim 1, wherein hydrogen peroxide is added in an amount of from 0.5 to 10 times a target amount, the target amount being determined in a series of preliminary experiments in which the amount of added hydrogen peroxide is varied, the concentration of dissolved oxygen is determined in the mineral pulp after addition of hydrogen peroxide, the concentration of dissolved oxygen is plotted against the amount of added hydrogen peroxide to give a curve having an inflection point, and the target amount of hydrogen peroxide is determined as the amount of hydrogen peroxide at the inflection point.

10. The method of claim 1, wherein the concentration of dissolved oxygen is determined in the mineral pulp after addition of hydrogen peroxide and the amount of hydrogen peroxide added is adjusted to maintain a minimum concentration of dissolved oxygen.

11. The method of claim 2, wherein hydrogen peroxide is added as an aqueous solution comprising 0.5 to 5% by weight hydrogen peroxide.

12. The method of claim 3, wherein hydrogen peroxide is added as an aqueous solution comprising 0.5 to 5% by weight hydrogen peroxide.

13. The method of claim 4, wherein hydrogen peroxide is added as an aqueous solution comprising 0.5 to 5% by weight hydrogen peroxide.

14. The method of claim 2, wherein the hydrogen peroxide is added less than 15 minutes before a gas is introduced for froth flotation.

15. The method of claim 3, wherein the hydrogen peroxide is added less than 15 minutes before a gas is introduced for froth flotation.

16. The method of claim 4, wherein the hydrogen peroxide is added less than 15 minutes before a gas is introduced for froth flotation.

17. The method of claim 11, wherein the hydrogen peroxide is added less than 15 minutes before a gas is introduced for froth flotation.

18. The method of claim 12, wherein the hydrogen peroxide is added less than 15 minutes before a gas is introduced for froth flotation.

19. The method of claim 13, wherein the hydrogen peroxide is added less than 15 minutes before a gas is introduced for froth flotation.

20. The method of claim 9, wherein the high chromium cast iron alloy is a martensitic solid solution free from pearlite and comprising less than 5% by weight austenite.

* * * * *